US006843347B2

(12) United States Patent
Lamberson et al.

(10) Patent No.: US 6,843,347 B2
(45) Date of Patent: Jan. 18, 2005

(54) STEP STOOL

(75) Inventors: Thomas Lamberson, Verona, WI (US); Michael R. Webb, Hubertus, WI (US); Richard C. Kochawski, Waldo, WI (US); Gene Gladkov, New Berlin, WI (US); Robert D. Heckel, II, Eagle River, WI (US)

(73) Assignee: RDL Investments, LLC, Eagle River, WI (US)

( * ) Notice: Subject to any disclaimer, the term of this patent is extended or adjusted under 35 U.S.C. 154(b) by 0 days.

(21) Appl. No.: 10/338,489

(22) Filed: Jan. 8, 2003

(65) Prior Publication Data

US 2004/0129495 A1 Jul. 8, 2004

(51) Int. Cl.[7] ..... A47C 13/00; A47C 7/00; E04F 1/00

(52) U.S. Cl. ..... 182/33; 182/20; 297/440.1

(58) Field of Search ..... 182/33, 35, 180.1, 182/222, 223, 151, 20; D25/65; 297/440.1, 130, 461, 440.12, 423.41, 423.44, 440.14

(56) References Cited

U.S. PATENT DOCUMENTS

| | | | | | |
|---|---|---|---|---|---|
| 2,622,658 | A | | 12/1952 | Morgan | |
| 3,788,700 | A | * | 1/1974 | Wartes | 297/440.13 |
| D273,919 | S | * | 5/1984 | Pasinski | D25/65 |
| 4,645,261 | A | * | 2/1987 | Bourne et al. | 297/118 |
| 4,763,580 | A | * | 8/1988 | Garland | 108/91 |
| 4,763,757 | A | | 8/1988 | Cheney | |
| 5,762,163 | A | * | 6/1998 | Kain | 182/161 |

FOREIGN PATENT DOCUMENTS

| | | | | |
|---|---|---|---|---|
| GB | 2043143 | * | 10/1980 | 182/35 |
| IT | 1344892 | * | 9/2003 | 182/180.1 X |

* cited by examiner

*Primary Examiner*—Hugh B. Thompson, II
(74) *Attorney, Agent, or Firm*—Joseph S. Heino; Patrick M. Bergin

(57) ABSTRACT

A multipurpose step stool includes two substantially parallel, congruent, triangular side support members. The triangular side support members each include first, second, and third resting edges adapted to contact a supporting surface such as a floor. The first treads are oriented parallel to the first resting edges, the second treads are oriented parallel to the second resting edges, and the platform is oriented parallel to the third resting edges. The angle between the first and second resting edges, and the positioning of the first and second treads are selected such that, when the first resting edges are placed on a support surface, a first orientation of the step stool is provided with the first and second treads in combination forming a first rise over run ratio; when the second resting edges are placed on a support surface, a second orientation of the step stool is provided with the second and first treads in combination forming a second rise over run ratio; and when the third resting edges are placed on a support surface, a third orientation of the step stool is provided with the platform elevated above the supporting surface.

7 Claims, 3 Drawing Sheets

STEP STOOL

FIELD OF THE INVENTION

The present invention relates generally to portable devices that may be used, among other things, to elevate a user to assist in the performance of certain tasks, to assist a user in reaching elevated places or items, and to support a user while standing or sitting on the device. More specifically, the present invention relates to a multipurpose step stool that allows the user to variably adjust the height of elevation by rotation and selective orientation of the step stool.

BACKGROUND OF THE INVENTION

Step stools and the like are well known. Indeed, it is common knowledge that a simple step stool can be an indispensable tool in helping an individual to complete daily tasks around the home, in the yard or at work. A step stool may be used to bring the user within reaching distance of an elevated place or object, and may even be used to reduce the user's exertion in reaching for an object that may not necessarily be out of reach. Depending upon what is desired or required by the user, the height to be obtained by the use of the step stool needs to be variable. Similarly, the step stool itself should allow the user to reach a variety of heights to maximize its usefulness. In the view of these inventors, what is needed is a new and useful step stool that is suitable for use in a wide variety of domestic and industrial applications.

SUMMARY OF THE INVENTION

The present invention provides a new and useful step stool that includes a pair of side support members, each side support member having a plurality of resting surfaces defined within it. In use, each side support member lies in a plane that is generally parallel to the plane that the other side support member lies in. A plurality of combination tread/riser members is provided, each tread/riser member being attachable to and extending generally perpendicularly between the side support members. In this fashion, a first orientation of the step stool provides a first level of elevation, a second orientation of the step stool (having a first rise over run ratio) provides a second, and multiple, level of elevation, and a third orientation of the step stool (having a second rise over run ratio) provides a third, and multiple, level of elevation. Each orientation and each level of elevation is attainable with the use of this single step stool device.

In the preferred embodiment of the step stool that is constructed in accordance with the present invention, the side support members and the combination tread/riser members are detachable from one another, to facilitate manufacturing, and to allow the step stool to be "knocked-down" flat for shipping and storage. In some versions of this embodiment of the invention, the side support members and the combination tread/riser members include integral interlocking latches and latch openings that are functionally adapted for connecting the tread/riser members to the side support members without using tools. Alternatively, more permanent fastening means may be used such as screws or nuts and bolts. The step stool of the present invention can be produced in many forms, adaptable to a wide range of uses. The step stool may be fabricated from a wide range of metallic and nonmetallic materials, material selection not being a limitation of the present invention. The step stool of the present invention is also adaptable to a wide range of sizes, including tall stools having three or more steps, and smaller, perhaps half scale, stools made specifically for children, size not being a limitation of the present invention either.

Other aspects and advantages of the new and useful step stool will be apparent to those having skill in the art upon review of the attached drawings and the following detailed description.

DETAILED DESCRIPTION

Figure 1:
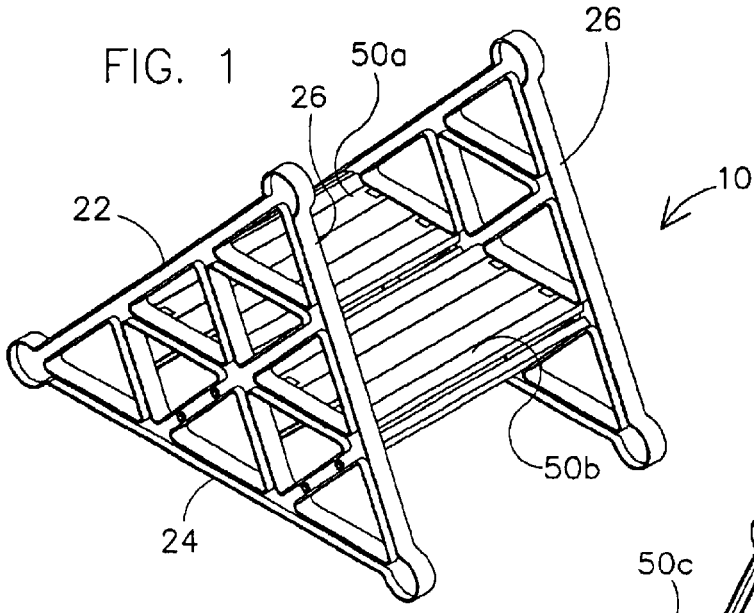
FIG. 1 is a top, left and front perspective view of a step stool constructed in accordance with the present invention and showing the step stool as it would be placed on a support surface in a first orientation to provide a first elevation.
Figure 2:
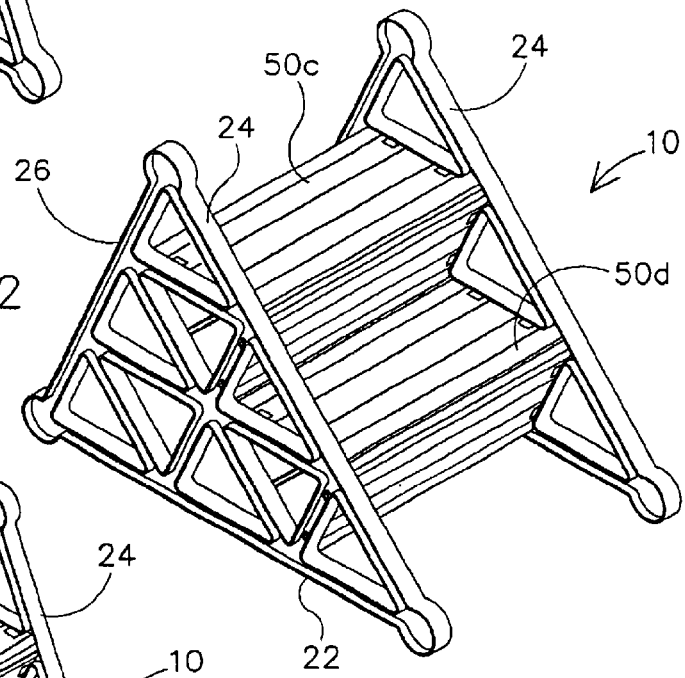
FIG. 2 is another perspective view of the step stool illustrated in FIG. 1 and showing the step stool as it would be placed on the support surface in a second orientation providing a first tread/riser ratio.
Figure 3:
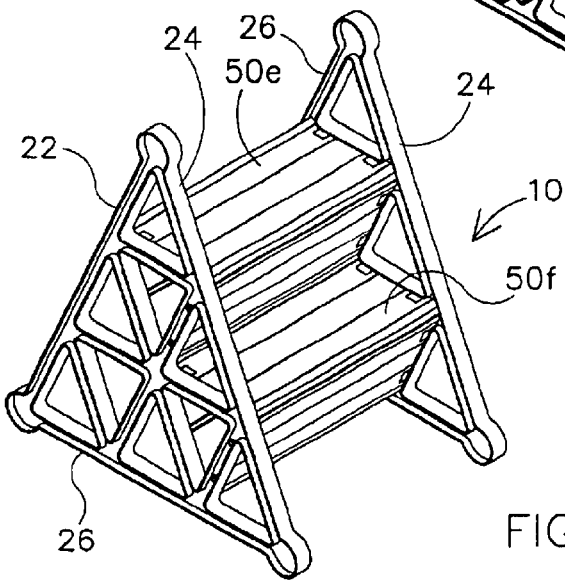
FIG. 3 is yet another perspective view of the step stool illustrated in FIG. 1 and showing the step stool as it would be placed on a support surface in a third orientation providing a second tread/riser ration.

Referring now to the drawings in detail wherein like numbered elements represent like elements throughout, FIG. 1 shows a preferred embodiment of a step stool, generally identified 10, constructed in accordance with the present invention. FIGS. 1, 2 and 3 show the step stool 10 as it would rest in a first, second and third orientation on a support surface such as a floor.

The step stool 10 includes a plurality of tread/riser units, generally identified 50, fastened between a pair of identically configured side support members 20. In the preferred embodiment of the device of the present invention, each side support member 20 is constructed in the form of a generally triangular frame having a plurality of integrally formed and intersecting I-beam type members. See FIG. 5. Specifically, each side support member 20 includes a first outer leg member 22, a second outer leg member 24 and a third outer leg member 26. The first and second outer leg members 22, 24 have the same length and form two sides of an isosceles triangle. The third outer leg member 26 forms the base of the triangle. The acute angle formed by first and second outer leg members 22, 24 is about 48° in the preferred embodiment. The acute angles formed by the first and third outer leg members 22, 26 and by the second and third outer leg members 24, 26 is about 66°. See FIG. 5. It is to be understood, however, that these angles could be varied and are not a limitation of the present invention.

A number of inner support members 32, 34, 36, 38, 42, 44 are also provided. Each inner support member 32, 34, 36, 38, 42, 44 is integrally formed as part of the side support member 20 and intersects one of the outer leg members 22, 24, 26. See FIG. 5. In the preferred embodiment, each inner support member 32, 34, 36, 38, 42, 44 is formed in an I-beam cross-section configuration. As shown, the inner support members 32, 34, 36, 38, 42, 44 each form a part of a generally hexagonal support structure. Also as shown, the inner support members 32, 34 are generally collinear. The inner support members 36, 42 are generally parallel to one another as are the inner support members 38, 44. The purpose and function of this configuration will become apparent further in this detailed description.

In the preferred embodiment, a plurality of tread/riser members, generally identified 50, are provided. See FIG. 6. Each tread/riser member 50 has an upper surface 52, a pair of side edges 54, 55 and a pair of end edges 56, 57. The end edges 56, 57 are those portions of the tread/riser members 50 that are engageable with the side support members 20, and the inner support members 32, 34, 36, 38, 42, 44 thereof in particular.

Referring again to FIG. 1, a first pair of generally planar tread/riser members 50*a*, 50*b* are oriented generally parallel to a plane formed by the second outer leg member 24 of each side support member 20. Referring to FIG. 2, a second pair of tread/riser members 50*c*, 50*d* are oriented generally parallel to a plane formed by the first outer leg member 22. And referring to FIG. 3, a third pair of tread/riser members 50*e*, 50*f* are shown oriented generally parallel to a plane formed by the third outer leg member 26 of each side support member 20.

As shown in FIGS. 2 and 3, the tread/riser members 50*c*, 50*d* and 50*e*, 50*f*, respectively, are staggered one from the other. In the embodiment depicted in FIGS. 1 through 4B, the first and third outer leg members 22, 26 form an acute angle with each other, and the riser/tread members 50*c*, 50*d*, used as treads, are spaced from a point of intersection 27 of projections of the first and third surfaces 22, 26, such that when the step stool 10 is resting in the second orientation, the tread/risers 50*e*, 50*f* form risers for the treads 50*c*, 50*d*. This combination forms a first rise over run ratio $Rise_1/Run_1$, which is relatively flat and suitable, for example, in assisting small children to reach important areas such as sinks and toilets.

Figure 4A:
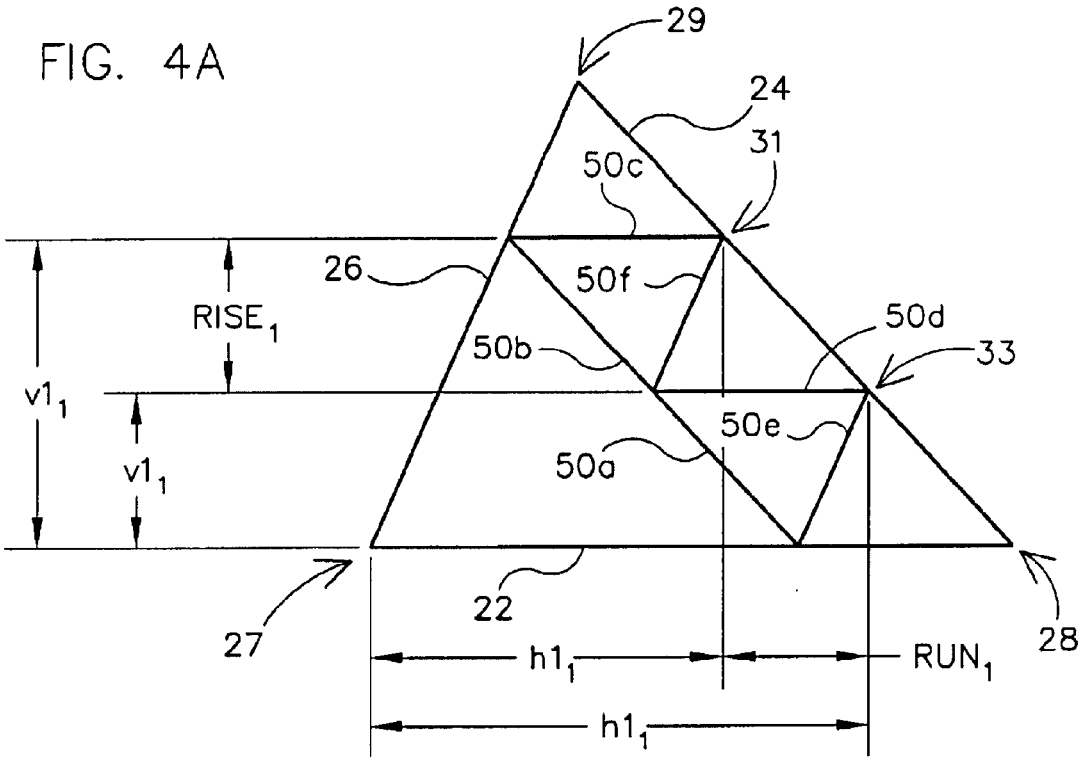
FIGS. 4A and 4B are schematic diagrams of the generally triangular side support members corresponding respectively to the first and second orientations of the step stool shown in FIGS. 2 and 3, respectively, and illustrating the first and second Rise/Run ratios thereof.
Figure 4B:
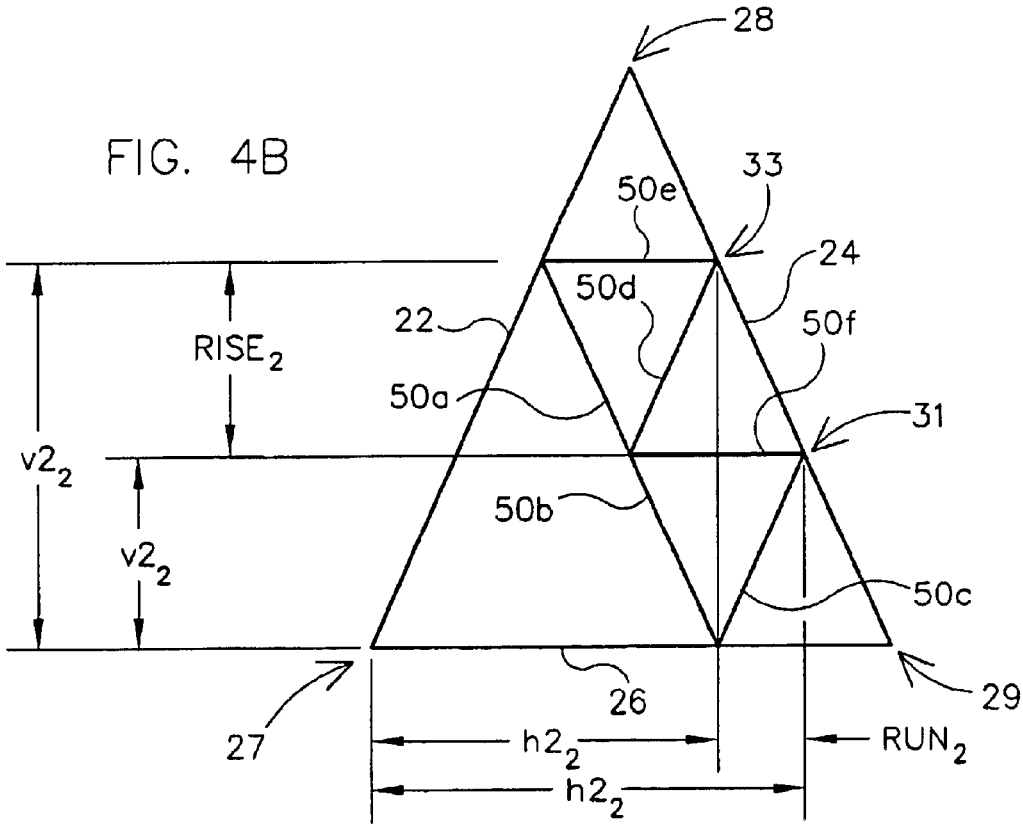

When the step stool 10 is positioned in the third orientation, as depicted in FIGS. 3 and 4B, with the third outer leg 26 in contact with a supporting surface, the treads 50*c*, 50*d* form risers to the treads 50*e*, 50*f*. This combination forms a second rise over ratio $Rise_2/Run_2$ that is steeper than the first rise over run ratio $Rise_1/Run_1$, thereby allowing the user to climb to a height suitable for reaching high spots such as the upper corners of a room or the tops of tall furniture or shelving.

In the embodiments depicted in FIGS. 1 through 3, the first, second and third outer leg members 22, 24, 26, which are also resting surfaces for the stool 10, extend almost the full length of the sides of the triangular side support members 20 and intersect with one another in rounded corners 28, rather than being truncated or cut off. Extending the resting surfaces 22, 24, 26 in this fashion provides increased stability in any of the first, second or third orientations, and also provides a grip rail extending above the treads and platform for the user to grasp while ascending or standing on the treads 50. This is particularly true where the cross-sectioned construction of each outer leg member 22, 24, 26 is in the form of an I-beam as previously described.

As shown in FIG. 4A, the first rise over run ratio $Rise_1/Run_1$ is calculated by projecting the first and third resting surfaces 22, 26 to a point of intersection 27 beyond the rounded corner 28, and dividing the difference in vertical distances $v1_1$, $v1_2$ (from the point of intersection 27 of the first and third resting surfaces 22, 26 to points of intersection 31, 33 of a projection of the working surfaces of the treads 50*c*, 50*d*) by the difference in horizontal distances $h1_1$, $h1_2$ (from the point of intersection 27 of the first and third resting surfaces 22, 26 to the points of intersection 31, 33 of the projections of the working surfaces of the treads 50*c*, 50*d*).

The second rise over run ratio $Rise_2/Run_2$ is calculated in similar fashion, as shown in FIG. 4B, by utilizing the vertical and horizontal distances $v2_1$, $v2_2$, $h2_1$, $h2_2$, from the point of intersection 27 of the projections of the first and second resting surfaces 22, 26 to the points of intersection 31, 33 of the projections of the treads 50*e*, 50*f*.

Figure 5:
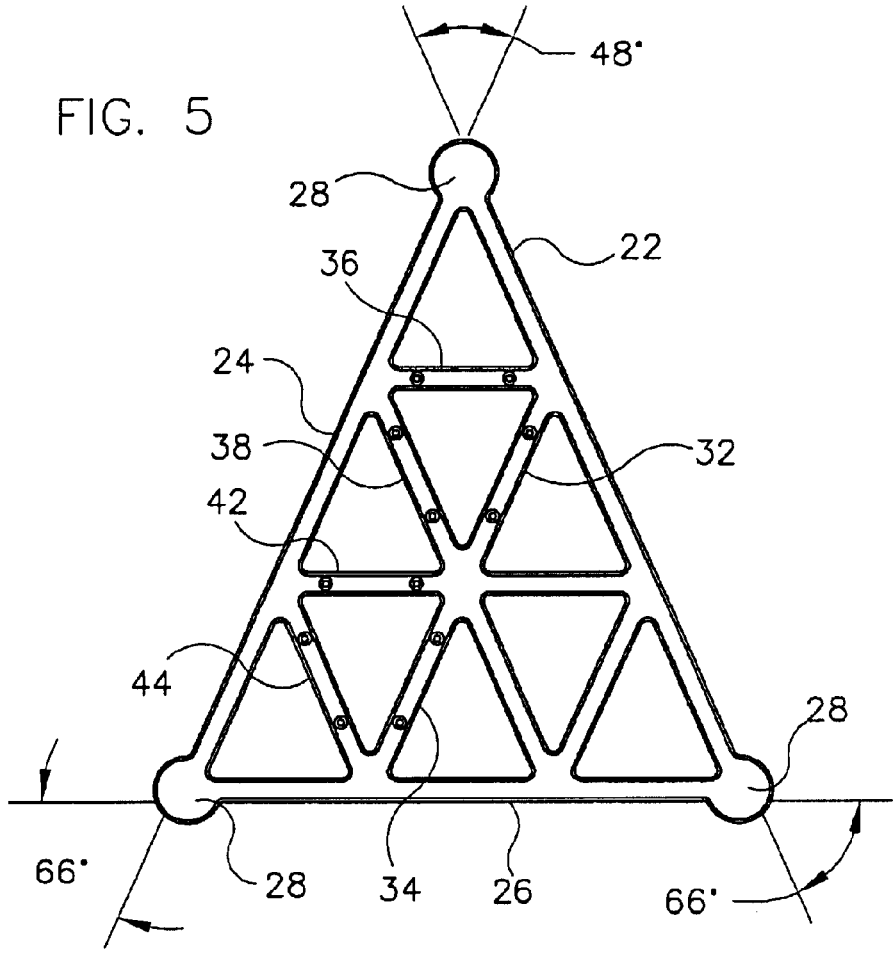
FIG. 5 illustrates one of a pair of the generally triangular side support members from an embodiment of the invention in which the combination tread/riser members are detachable from the side members by used of conventional fasteners.
Figure 6:
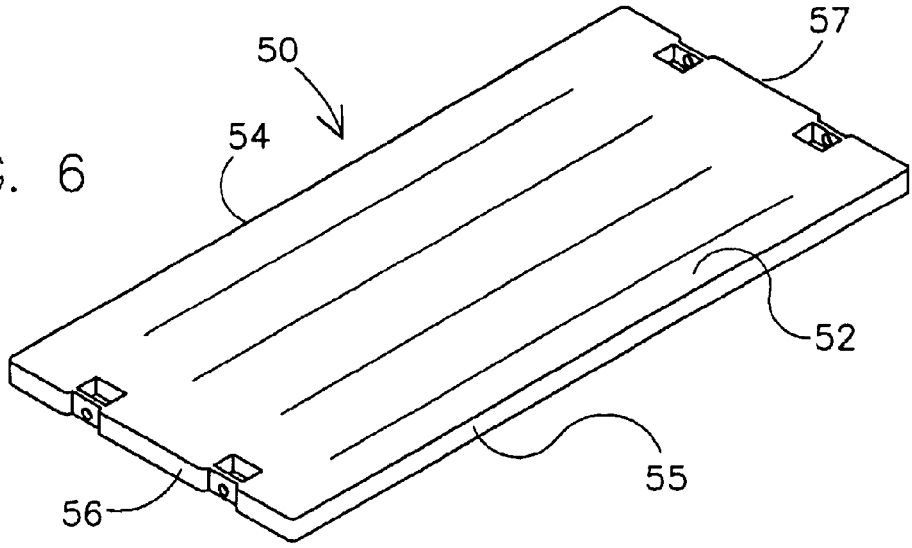
FIG. 6 is a perspective view of one of the tread/riser members that is shown molded as one piece.

In some forms of the step stool 10 of the present invention, it may be advantageous to have some of the component parts, i.e., the treads 50, or the side support members 20, integrally joined together in an inseparable unit. In other forms of the step stool 10, however, it may be advantageous to have some or all of the components of the step stool 10 be detachable from the other components to facilitate manufacturing, shipping, or storage of the step stool 10. FIGS. 5 and 6 depict an embodiment of the step stool 10 having a pair of identical side support members 20 (only one shown) that are detachable from a series of identical tread units 50 (only one shown) that can be positioned and attached to the side support members 20 as previously described. In this fashion, the first pair of tread/riser members 50*a*, 50*b* are removably attachable to the inner support members 32, 34, respectively, of the side support members 20. The second pair of tread/riser members 50*c*, 50*d* are similarly removably attachable to the inner support members 44, 38, respectively, of the side support members 20. And the third pair of tread/riser members 50*e*, 50*f* are removably attachable to the inner support members 36, 42, respectively. It is to be understood that each riser/tread member 50 is attachable to each side support member 20 by use of conventional fastening means. In this fashion, and with this configuration, the second pair of tread/riser members 50*c*, 50*d* serve as the risers for the third pair of tread/riser members 50*e*, 50*f* when those members are used as treads and vice versa.

The step stool 10 of the present invention can be fabricated from a wide variety of materials, by a number of methods, and in a number of forms or sizes dependent upon the size of the user, and the nature of the use. In one preferred form of my step stool 10, the side plates and treads as depicted in FIGS. 1 through 3, 5 and 6 could be cast from aluminum or other metal material. They could also be injection molded from a polypropylene material. When such a material is used, it may be desirable to reinforce the intersection of the first, second and third resting surfaces 22, 24, 26, as shown by the partial circular enlargements at reference numeral 28 in FIG. 5. Where such enlargements extend out of the planes defined by the first, second and third resting surfaces 22, 24, 26, stability of the step stool 10 on soft surfaces such as carpet or turf may be enhanced by having the enlargements 28 penetrate the supporting surface slightly.

It is to be understood, therefore, that the scope of the disclosure and appended claims are not limited to the specific embodiments described and depicted herein.

What is claimed is:

1. A step stool comprising (a) a pair of identically configured and triangle-shaped side support members, each side support member including (i) a first leg member, (ii) a second leg member, and (iii) a third leg member, each of said first, second and third leg members being one side of the triangle-shaped configuration, wherein the first leg members of the side support members form a base for the step stool in a first orientation of the step stool relative to a horizontal surface, wherein the second leg members of the side, support members form a base for the step stool in a second orientation of the step stool relative to a horizontal surface, wherein the third leg members of the side support members form a base for the step stool in the third orientation of the step stool relative to a horizontal surface; and (iv) each side support member further including a plurality of inner support members comprising (a) a first inner support member, (b) a second inner support member, said first and second inner support members being substantially collinear and further being substantially parallel to the second leg member of the side support member at a first distance, (c) a third inner support member, (d) a fourth inner support member, said third inner support member being substantially parallel to the first leg member of the side support member at said first distance and said fourth inner support member being substantially parallel to the third inner support member at said first distance, (e) a fifth inner support member, and (f) a sixth inner support member, said fifth inner support member being substantially parallel to the third leg member of the side support member at a second distance and the sixth inner support member being substantially parallel to the fifth inner support member at said second distance; and (b) a plurality of tread members comprising (i) a first substantially planar tread member that extends between, and is substantially coplanar with, the first inner support members of the side support members, (ii) a second substantially planar tread member that extends between, and is substantially coplanar with, the second inner support members of the side support members, whereby the first and second tread members form a platform above the horizontal surface at the first distance when the step stool is in the first orientation, (iii) a third substantially planar tread member that extends between, and is substantially coplanar with, the third inner support members of the side support members, (iv) a fourth substantially planar tread member that extends between, and is substantially coplanar with, the fourth inner support members of the side support members, whereby the third and fourth tread members form two steps, the first step being at the first distance above the horizontal surface and the second step at twice the first distance above the horizontal surface, (v) a fifth substantially planar tread member that extends between, and is substantially coplanar with, the fifth inner support members of the side support members, (vi) a sixth substantially planar tread member that extends between, and is substantially coplanar with, the sixth inner support members of the side support members, whereby the fifth and sixth tread members form two steps, the first step being at the second distance above the horizontal surface and the second step at twice the second distance above the horizontal surface.

2. The step stool of claim 1 wherein the first and second leg members of each side support member have substantially the same length and the third leg member of each side support member is shorter than either the first or second leg members.

3. The step stool of claim 1 wherein the angle formed by the first and second leg members of each side support member is about 48° and the angles formed by the first and third leg members, and by the second and third leg members is about 66°.

4. The step stool of claim 1 wherein each inner support member is formed in an I-beam cross-section configuration.

5. The step stool of claim 1 wherein each inner support member of each side support member forms part of a generally hexagonal support structure that is disposed within the first, second and third leg members of the side support member.

6. The step stool of claim 1 wherein each tread member is mechanically fastened to each of the side support members at the point of the corresponding inner support members that the tread member extends between.

7. The step stool of claim 1 wherein each tread member is removably attachable to each of the side support members at the point of the corresponding inner support members that the tread member extends between.

* * * * *